United States Patent [19]

Cimprich et al.

[11] 4,304,169

[45] Dec. 8, 1981

[54] BRAIDING MACHINE

[75] Inventors: Francis J. Cimprich, Canton; John J. Boyd, Akron; William J. Wessner, Jr., Marion, all of Ohio

[73] Assignee: The B. F. Goodrich Company, Akron, Ohio

[21] Appl. No.: 60,718

[22] Filed: Jul. 26, 1979

[51] Int. Cl.[3] ..... D04C 3/06; D04C 3/22

[52] U.S. Cl. ..... 87/29; 57/1 R; 87/33; 87/44; 181/290; 428/461; 428/465

[58] Field of Search ..... 87/29, 33, 37, 38, 44, 87/50, 51, 55; 57/1 R, 136, 137; 181/290; 428/461–463, 465; 248/632, 637, 638, 659

[56] References Cited

U.S. PATENT DOCUMENTS

| | | | |
|---|---|---|---|
| 909,709 | 1/1909 | Taylor | 87/29 |
| 1,913,936 | 6/1933 | Lee | 248/638 X |
| 2,918,777 | 12/1959 | Reeve et al. | 87/29 X |
| 3,562,091 | 2/1971 | Oberst et al. | 428/463 X |
| 3,604,191 | 9/1971 | Jaeggli | 57/136 X |
| 3,674,625 | 7/1972 | Oberst et al. | 428/463 X |
| 3,722,618 | 3/1973 | Butterfield et al. | 181/290 X |
| 3,783,736 | 1/1974 | Richardson | 87/29 |
| 4,096,307 | 6/1978 | Lagowski | 428/462 X |
| 4,144,910 | 3/1979 | Bader | 181/290 X |
| 4,223,073 | 9/1980 | Caldwell et al. | 428/463 X |

*Primary Examiner*—John Petrakes

*Attorney, Agent, or Firm*—Joseph Januszkiewicz

[57] ABSTRACT

A braiding machine for use in the manufacture of braided hose. The machine has the rear deck interconnected to the front deck which front deck is composed of three separate elements, the inner deck plate, the outer deck plate and the quoits. The respective elements are of a sandwich construction, wherein a viscoelastic material is bonded to outer plate members to provide a dampening of the noise. In addition, the carrier members are similarly constructed to dampen the noise by a sandwich construction, wherein the flanges of the carrier have an inner layer of viscoelastic materials. The carriers which support the wire spools are driven in a criss-crossing pattern to provide a braiding action of the wire as it is layed onto a longitudinally moving hose.

7 Claims, 9 Drawing Figures

BRAIDING MACHINE

BACKGROUND OF THE INVENTION

This invention relates to braiding machines, and more particularly to a braiding machine having constrained layer noise dampening means to reduce the braider noise.

In the manufacture of such products as high pressure hydraulic or pneumatic hose, wire is tightly woven over a tubular mandrel or core in cooperation with layers of gum to form layers of braided sheath about the hose. The winding or braiding of textile core or wire is achieved by moving a tube or mandrel longitudinally while moving a plurality of bobbins mounted on carriers circumferentially around the tube in crisscrossing fashion as a maypole. These paths are two generally circumferentially extending sinuous paths which crisscross each other. The parts are created on a vertically disposed deck which has crisscrossing or sinuous paths. The deck has a front and rear deck plate, with the front deck plate having an inner plate, a quoit or oval plate and an outer plate, all interconnected to the rear deck plate. The inner and outer plates in cooperation with the quoit define a pair of crisscrossing sinuous grooves in which the carriers travel. Each carrier has a stub which is moved or handed off from one geneva gear to another geneva gear as other gears drive the geneva gear. The geneva gears are mounted on shafts that interconnect the quoit to the rear deck plate. The web of the carrier acts as a cam in the front deck plate groove to move the carriers along the fixed sinuous path. The respective carriers support spindles or bobbins of yarn or wire and as they crisscross each other they braid the strands of yarn or wire onto the central longitudinally movable mandrel.

A major problem with such braiding machines is that the noise level is very high as to be irritating and injurious as well as illegal in view of the noise limits being set by the Occupational Safety and Health Administration (OSHA). Therefore, noise suppression is desirable in the design of machines. In the case of the horizontal braiding machine the noise level is intense through the turning of the geneva gear between two deck plates and through a plurality of circumferentially extending and meshing gears. In addition to these noises, the spindle carriers being propelled along a metal track in a crisscrossing braiding pattern results in a further generation of a high noise level as the carrier is transferred, propelled or thrown from one guiding slot to another. A further source of noise is the vibration due to the suspension of the metal parts such as the quoit and outer deck as the carriers are moved thereby. Additional sources of noise is the effect of gravity pulling down on the carriers trying to pull the carrier out of the front of the deck, and the centrifugal force trying to throw the carrier away from the geneva gear or wheel into the edge of the deck. In addition, the tension of the wire or yarn required to make the correct lay onto the hose being fabricated can result in an additional force of as much as 40 pounds on some wire hose constructions. It being understood that there is considerably more tension required and demanded of a braiding machine fabricating a high pressure hydraulic hose which may have to withstand a burst pressure of 18,000 psi in comparison to the fabrication of items such as shoe laces, jump rope and candle wicks.

Sound measurement is usually expressed in dB (decibels), a relative quantity based on a reference power of $10^{-12}$ Watts. Sound intensity is the average rate of sound energy transmitted through a unit area normal to the wave direction at the point considered. This is a definition of power and may be expressed in watts per square meter. It is usual however to express power in decibels, dB or db, which is a term used to give the relative magnitude of two powers by comparing the one under consideration to a standard. At the threshold of hearing the sound power level is 0 db. At the other end of the scale, a 140 db is the threshold of pain. The human ear does not perceive an increase in sound pressure level as a proportionate increase in loudness. Moreover, the ear does not respond equally to all frequencies. Therefore, a frequency weighted scale called dbA or dBA is often used in noise studies to simulate human hearing response in the audible range from 20 to 20,000 Hz. In dBA units sound pressure measured in db or dB is scaled according to a frequency-response curve determined by international acoustic standards.

The present invention is directed to the layer damping of the decks, including the inner deck, quoit and outer deck. In addition, the carrier has the layer dampening applied thereto to thereby substantially reduce the noise level. The alternatives to Applicant's method and apparatus is to construct a housing to encompass the braider decks; however, this presents problems in servicing the decks and to properly observe and correct malfunctions. In certain instances, there is an insufficient amount of clearance space between adjacent braiding machines and to install housings would require the relocating of the braider machines or to reduce the number of braider machines in a shop.

SUMMARY OF THE INVENTION

The present invention contemplates a braiding machine having its braider decks constructed with a layer of visco-elastomeric material sandwiched between the inner and outer plates that make up the respective front decks, which include the inner deck plate, the quoit or oval plate, and the outer deck plate. These deck plates and quoits cooperate to define the criss-crossing sinuous paths or tracks for the carriers which support the spools of strand material used in effecting the braiding operation. The carriers are also constructed with a noise dampening material such as a visco-elastic material in the flanges adjoining the web to isolate and dissipate the noise energy. The quoits, inner deck plate and outer deck plate are all isolated from each other and are separately attached to the rear deck plate which in turn is supported by the base of the braiding machine.

BRIEF DESCRIPTION OF THE INVENTION

DETAILED DESCRIPTION

Figure 1:
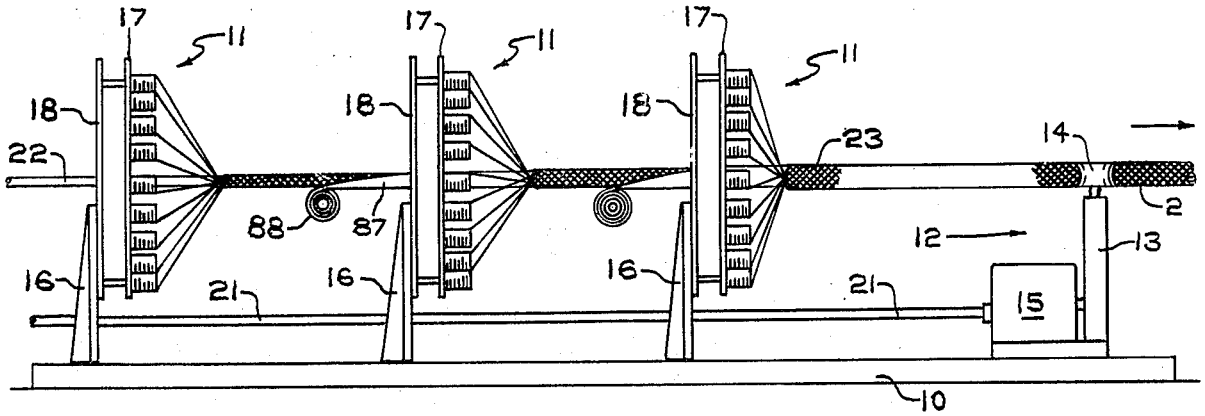
FIG. 1 is a side elevational view in semischematic form showing the general arrangement of the braiding apparatus.

Referring now to the drawings wherein like reference characters designate like or corresponding parts throughout the several views there is shown in FIG. 1 a base 10 supporting a plurality of braider decks 11, and a mandrel guide assembly 12. Guide assembly 12 includes a stand 13, drive rollers 14 and suitable drive means 15 for rotating the rollers 14 and gears in the braider decks to be described. Three braider decks 11 are shown, although a greater number or lesser number may be employed in accordance with the number of sheaths to be wound onto the hose. The construction of the respective braider decks are similar and therefore only one deck will be described.

Figure 2:
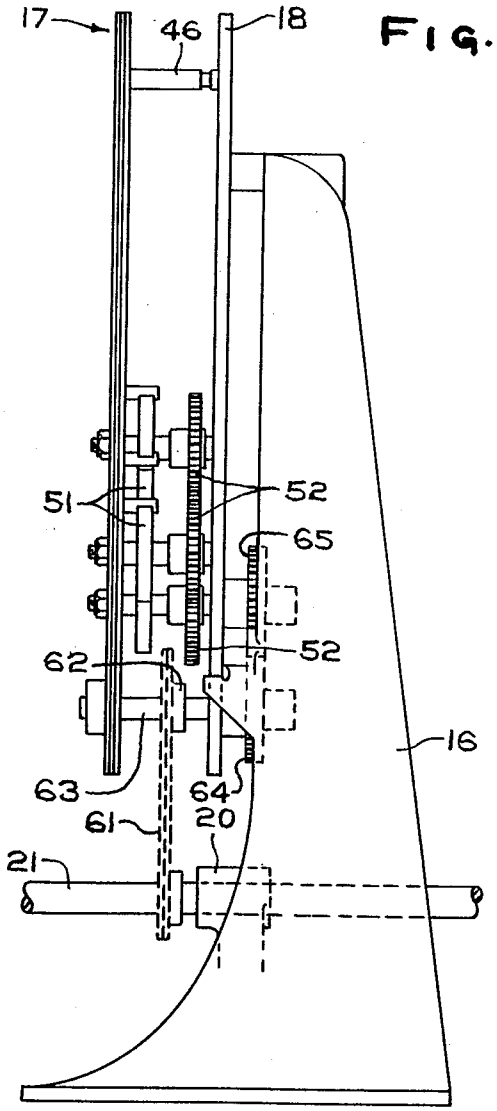
FIG. 2 is an enlarged side elevational view of a braider deck with a portion of the gears and carriers in plate to illustrate the relationship of paths.

The braider deck 11 includes a support member or stand 16, a front deck plate 17 and a rear deck plate 18. Each support member 16 of the respective braider decks 11 have aligned bushings 20 (FIG. 2) for supporting a common drive shaft 21 rotated by drive means 15, which in turn drives the gears to be described in the braider decks 11. A mandrel 22 with a braided tube 23 being formed thereon is moved longitudinally through the braider decks 11 of the braiding machine for braiding wire onto the tube in a manner to be described.

Figure 3:
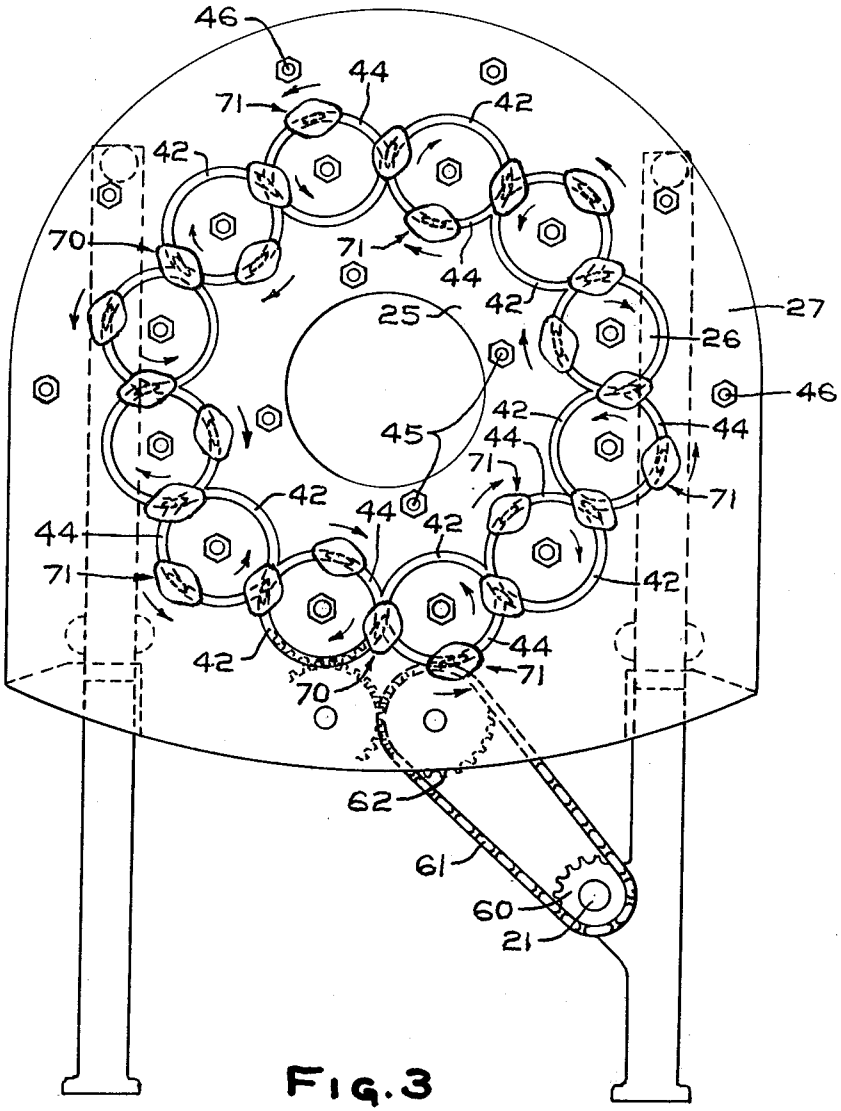
FIG. 3 is a front view of a braider deck showing the carriers without spindles positioned along the sinuous path.
Figure 6:
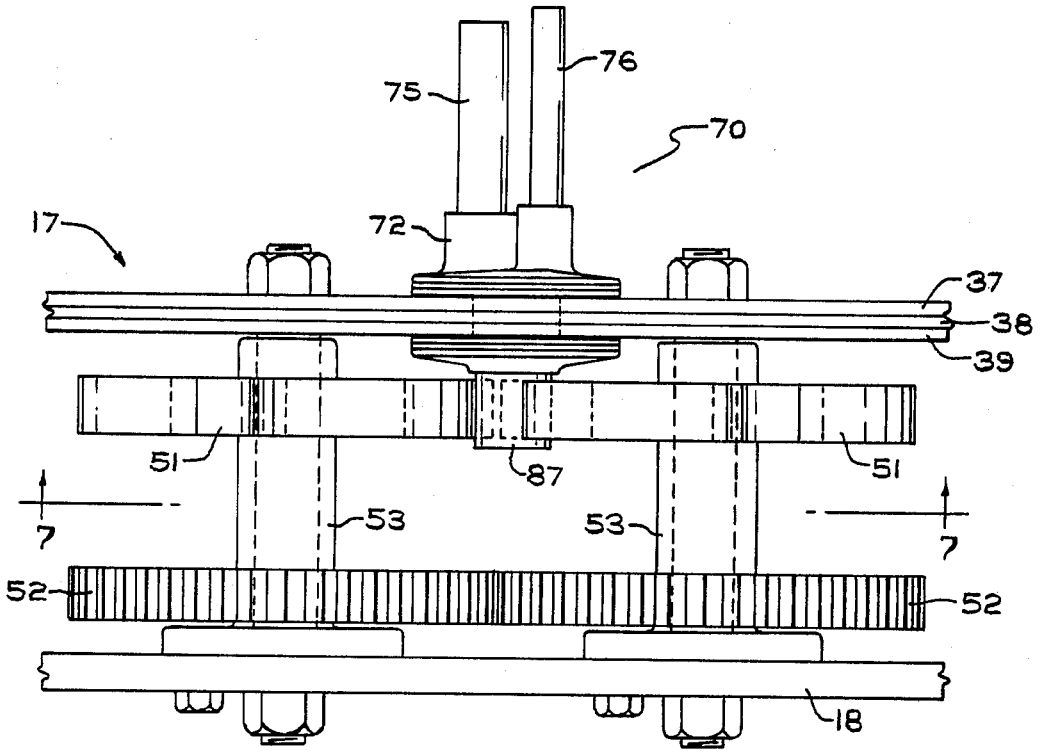
FIG. 6 is a plan view of a portion of the braider deck showing a portion of the rear deck plate, the laminated front deck plate and carrier with its spindle.

The front deck plate 17 (FIG. 3) consists of an inner deck plate 25, quoits 26 or a plurality of oval plates and an outer deck plate 27. Inner deck plate 25 has an outer periphery that is a series of interconnected loops which forms a portion of the cam groove or track to be described. The inner deck plate 25 (FIG. 4) is a laminated construction having a front metal portion or section 30 laminated with a visco-elastic material 31 to a rear metal portion or section 32. In a similar manner, the quoit 26 consists of a front metal portion or section 34 laminated with a visco-elastic material 35 to a rear metal portion or section 36. The outer deck plate 27 has a similar sandwiched construction, with a front metal portion or section 37 laminated with a visco-elastic material 38 to a rear metal portion or section 39. Thus, the front deck plate 17 (FIGS. 6 and 4) is a sandwiched constructed plate with a noise dampening material therein. The noise dampening material is a layer bonded to a pair of metal plates to suppress vibration and isolate the noise.

The outer deck plate 27 (FIG. 4) is circumferentially extending having its inner periphery in the shape of a series of interconnected loops. The quoit 26 is oval in shape (FIGS. 3 and 5) with the respective adjacent edges rather pointed to accommodate the transfer of the carriers to be described. The respective inner deck plate 25, quoits 26, and outer deck plate 27 cooperate to define an outer groove, or first track 42 and an inner groove or second track 44, which tracks 42 and 44 crisscross each other.

Figure 4:
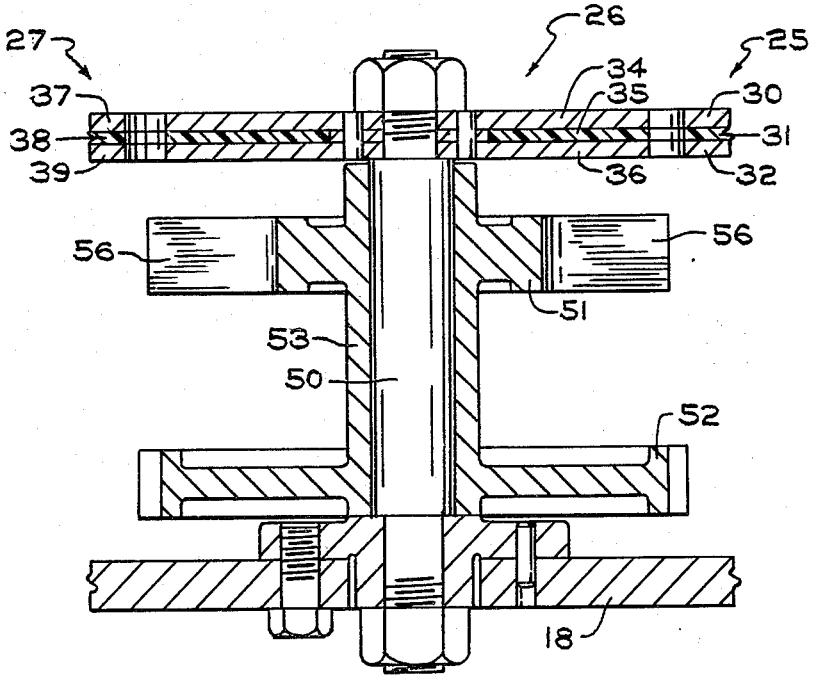
FIG. 4 is a cross sectional view of a portion of a braider deck showing the quoit or oval plate, geneva gear and a spur gear.
Figure 8:
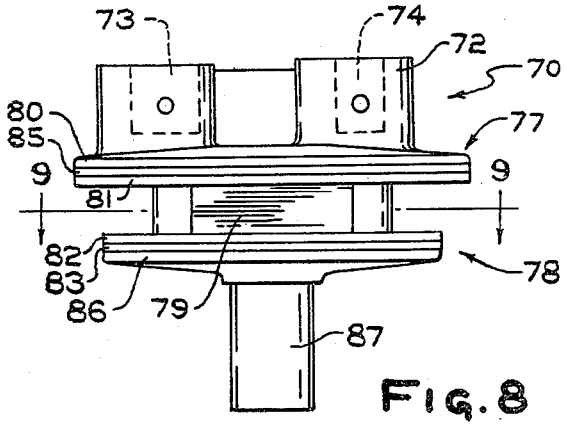
FIG. 8 is a side view of a carrier.
Figure 5:
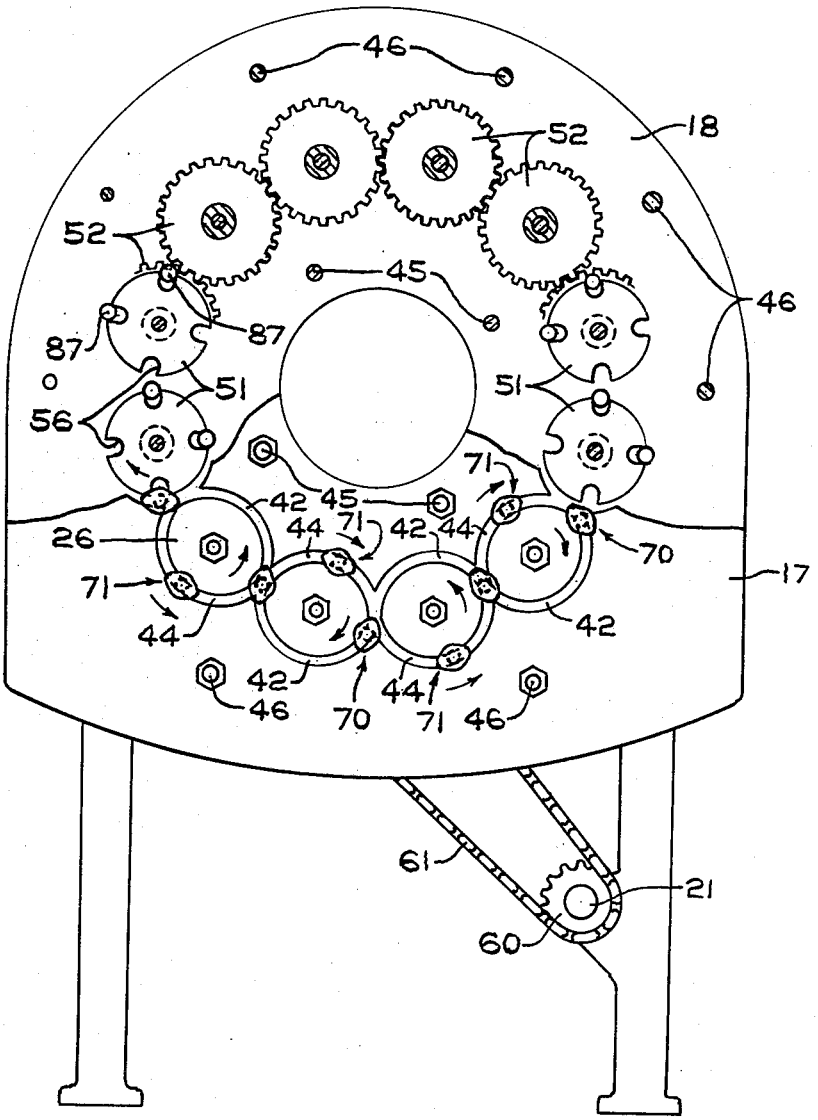
FIG. 5 is a fragmentary front view of a braider deck having the inner deck broken away to illustrate the spur and geneva gears.

The inner deck plate 25 is rigidly secured to the rear deck plate 18 as by spacer studs 45. The outer deck plate 27 is secured to the rear deck 18 in a similar manner by studs 46. Each quoit 26 is suspended between the inner deck plate 25 and the outer deck plate 27 by a spacer stud or shaft 50 that interconnects the quoit 26 to the rear deck 18 (FIG. 4).

Figure 7:
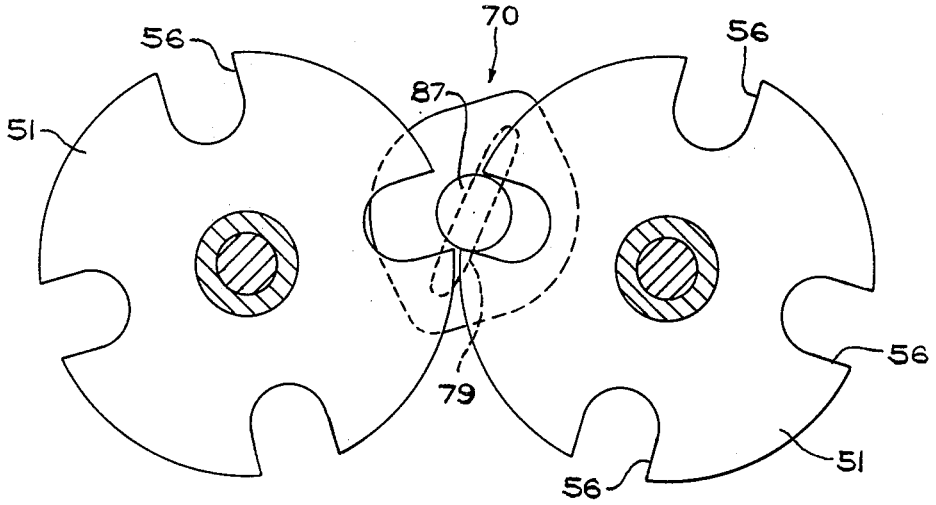
FIG. 7 is a front fragmentary view of the geneva gear and the carrier's web taken on line 7—7 of FIG. 6.

Journaled for rotation on the respective shafts 50 is a geneva gear or wheel 51 and a spur gear 52, which gears have a common interconnecting tubular member 53. Each geneva gear as shown in FIG. 7 has four slots 56 equally spaced about the periphery thereof.

The drive shaft 21 is suitably keyed to the respective sprockets 60 (FIG. 3) which in turn is connected by a chain 61 to a sprocket 62. Sprocket 62 is connected to a shaft 63 that has a spur gear 64 connected thereto. Gear 64 meshes with a gear 65 which in turn suitably drives one of the spur gears 52 which is in driving engagement with the remaining spur gears 52 such that each adjacent spur gear 52 is rotated in opposite direction as is their geneva gears 51.

Figure 9:
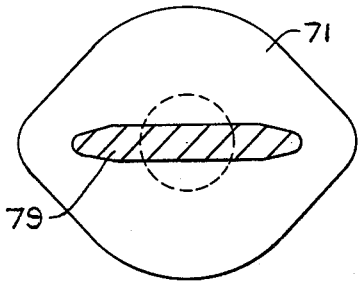
FIG. 9 is a cross-sectional view of a carrier taken along line 9—9 of FIG. 8.

A plurality of carriers 70 and 71 are mounted in the tracks 42 and 44 respectively. Only one carrier 70 will be described, it being understood that all carriers are alike. Each carrier 70 has a body 72 with bores 73 and 74 to which is attached a spindle 76, and a strand guide support 75. The carrier 70 includes two oppositely disposed flat flanges 77 and 78 held in spaced relationship by an integral web 79. Each flange 77 and 78 has a pair of metal plates 80–81 and 82–83 respectively suitably bonded to visco-elastomeric sheets 85 and 86. The sandwich construction of the carriers thus abate the noise generated as they are guided or propelled in their respective tracks 42 and 44. The web 79 as seen in FIG. 9 has an elongated body with tapered end portions that guide the carrier in the grooves or tracks 42 and 44. The flange 78 has a cylindrical shaft member or cam 87 extending outwardly therefrom, which cam 80 rides in the slots 56 of the geneva gears 51.

In the operation of the described braiding machine, the carriers 70 and 71 are driven in their respective grooves or tracks 42 and 44 which are sinuous in pattern and in timed relationship. This action is achieved by the rotation of shaft 21 by motor drive means 15 which in turn drives the spur gears 52 and the geneva gears 51. The adjacent geneva gears are driven in opposite directions such that the carriers 71 are driven in a clockwise direction in track 44 while carriers 70 are driven in a counterclockwise direction in track 42. This action of the carriers operates to interlace the wire strands from the spindles or spool of wire to a braid onto the longitudinally movable mandrel 22. A covering of gum 87 is wound onto the hose by a spool 88 shown schematically in FIG. 1 in preparation for the braiding of a second set of wires onto the hose from a second deck 11. Additional gum and braids may be employed downstream of the described decks to form as many layers as desired. As the carriers 70 and 71 are driven along tracks 42 and 44, considerable vibration is ordinarily set up by the metal carriers engaging the metal tracks and the rapid angular acceleration imparted to the carriers by their change in direction. With the inner deck plate 25, quoits 26 or oval plates and the outer deck 27 being constructed with a damping layer of visco-elastomeric material between the metal plates 30,32,34,36 and 37,39 the vibration is materially reduced. In addition the carrier 70, with its visco-elastomeric constructed flanges as described above, further reduces the noise level by dampening the vibration ordinarily imparted by the carriers as they are propelled in their respective tracks. With the carriers constructed in the manner described above the noise level reduction achieved in a deck having 24 carriers is in the order of 6 dBA. The sandwich constructed deck plates and carriers as described above can reduce the noise level to below the 90 dbA level set forth by OSHA.

It will be apparent that, although a specific embodiment and certain modifications of the invention have been described in detail, the invention is not limited to the specifically illustrated and described constructions since variations may be made without departing from the principles of the invention.

We claim:

1. In a braiding machine for manufacturing braided hose having at least a front deck and a rear deck, said rear deck mounted on a base; each of said decks having a central bore defining a longitudinal pass line for a hose onto which wire strands are wound to braid said hose; said front deck having a pair of crisscrossing sinuous grooves that extend circumferentially around and through said front deck to provide an inner deck plate, an outer deck plate and a plurality of circumferentially spaced oval plates; all of said plates secured to said rear deck in spaced parallel relationship; a plurality of wire strand carriers slidably mounted in said grooves, drive means operatively connected to said carriers to move said carriers in timed relationship in said groove in crisscrossing manner to provide a braiding action from dispensed wires onto said hose; all of said plates having a layer of viscoelastic material bonded and sandwiched between two metal plates to dampen noise.

2. In a braiding machine as set forth in claim 1 wherein all of said plates have a front surface and a rear surface, said front surfaces lying a common plane.

3. In a braiding machine as set forth in claim 2 wherein the thickness of viscoelastic material relative to the entire thickness of said plates is in the range of ratio of between $\frac{1}{8}$ to $\frac{1}{3}$.

4. In a braiding machine as set forth in claim 3 wherein each of said carriers has a pair of spaced flanges secured to a web portion, said web portion being received by said groove, said flanges slidingly engage said front and rear surfaces of said plates, and each of said flanges having a layer of viscoelastic material bonded and sandwiched between two metal plates to dampen noise.

5. In a braiding machine having a braider deck, said braider deck having a front planar deck and a rear planar deck, said braider deck having a central bore defining a longitudinal pass line, said front deck having an inner deck plate secured to said rear deck by a plurality of spacers, an outer deck plate secured to said rear deck by spacers, a plurality of oval plates located in a plane between said inner deck plate and said outer deck plate to define a pair of sinuous tracks therebetween, said pair of tracks crisscross between adjacent ones of said oval plates, each of said oval plates are secured to said rear deck by a spacer shaft, a spur gear mounted on each of said spacer shafts, all of said spur gears spaced equidistant from said longitudinal pass line and being in meshing engagement with each other, a geneva gear mounted on each of said spacer shafts and being secured to the spur gear mounted on the same spacer shaft as said geneva gear, and each of said inner deck plate, said outer deck plate and said oval plates constructed with two spaced metal plates bonded to an intermediately located viscoelastic material to provide a sandwich type structure.

6. In a braiding machine having a braider deck; said braider deck having a front deck and a rear planar deck; said front deck having an inner deck plate, an outer deck plate and a plurality of oval plates; said inner deck plate having a central bore therethrough defining a longitudinal pass line; said rear deck having a central aperature whose centerline is coincident with said longitudinal pass line; said inner deck plate having an outer periphery with a series of interconnected semi-circular recesses having apexes equidistant from said pass line; said inner deck plate secured in spaced relationship to said rear deck with a plurality of spacer support members; said outer deck plate having an inner periphery with a series of interconnected semi-circular recesses defining a plurality of spaced apexes that are closely adjacent to said apexes of said inner deck plate having a small gap therebetween; said outer deck plate and said oval plates secured in spaced relationship to said rear deck; said semi-circular recesses of said inner deck plate and said outer deck plate define a series of oval recess; each of said oval recesses receives one of said oval plates with a clearance space therebetween to define a groove; a plurality of wire strand carriers slidably mounted in said grooves, means operatively connected to said carriers to move said carriers in timed relationship in said grooves; the frontal surfaces of said inner deck plate lying in the same plane as the frontal surface of said oval plates and the frontal surface of said outer deck plate; and each of said inner deck plate, each of said outer deck plate and all of said oval plates constructed of a pair of spaced metal plates bonded to an intermediate elastomeric sheet member to provide a sandwich constructed inner deck plate, a sandwich constructed outer deck plate and oval sandwich constructed plates.

7. In a braiding machine as set forth in claim 6 wherein each of said carriers has a pair of spaced flanges secured to a web portion, said web portion being received by said groove, said flanges sliding engage said metal plates adjacent to said grooves, and each of said flanges having a layer of viscoelastic material bonded and sandwiched between two metal plates to dampen noise.

* * * * *

UNITED STATES PATENT AND TRADEMARK OFFICE

Certificate

Patent No. 4,304,169 Patent December 8, 1981

Francis J. Cimprich, John J. Boyd & William J. Wessner, Jr.

Application having been made by Francis J. Cimprich, John J. Boyd and William J. Wessner, Jr., the inventors named in the patent above identified, and the B. F. Goodrich Co., New York, N.Y., a corporation of New York, the assignee, for the issuance of a certificate under the provisions of Title 35, Section 256, of the United States Code, adding the name of Hassan Subhi Ghazi as a joint inventor, and a showing and proof of facts satisfying the requirements of the said section having been submitted, it is this 26th day of July 1983, certified that the name of the said Hassan Subhi Ghazi is hereby added to the said patent as a joint inventor with the said Francis J. Cimprich, John J. Boyd and William J. Wessner, Jr.

Fred W. Sherling,
*Associate Solicitor.*